US008920186B2

(12) United States Patent
Shishikura

(10) Patent No.: US 8,920,186 B2
(45) Date of Patent: Dec. 30, 2014

(54) ELECTRICAL CONNECTOR HAVING A DEFORMABLE LOCK ARM

(71) Applicant: Tyco Electronics Japan G. K., Kanagawa-ken (JP)

(72) Inventor: Seiji Shishikura, Chiba (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 29 days.

(21) Appl. No.: 13/720,061

(22) Filed: Dec. 19, 2012

(65) Prior Publication Data

US 2013/0171857 A1 Jul. 4, 2013

(30) Foreign Application Priority Data

Dec. 28, 2011 (JP) ..... 2011-288047

(51) Int. Cl.

| | |
|---|---|
| ***H01R 13/627*** | (2006.01) |
| ***H01R 13/518*** | (2006.01) |
| ***H01R 13/506*** | (2006.01) |
| ***H01R 13/436*** | (2006.01) |
| ***H01R 13/641*** | (2006.01) |
| ***H01R 13/514*** | (2006.01) |

(52) U.S. Cl.

CPC ..... *H01R 13/436* (2013.01); *H01R 13/518* (2013.01); *H01R 13/506* (2013.01); *H01R 13/641* (2013.01); *H01R 13/514* (2013.01)

USPC ..... 439/352

(58) Field of Classification Search

USPC ..... 439/352, 752, 541.5

See application file for complete search history.

(56) References Cited

U.S. PATENT DOCUMENTS

| | | | | |
|---|---|---|---|---|
| 7,470,138 | B1 * | 12/2008 | Chen et al. | 439/352 |
| 7,695,315 | B2 * | 4/2010 | Hitchcock et al. | 439/541.5 |
| 7,841,913 | B2 * | 11/2010 | Hitchcock et al. | 439/752 |
| 2006/0116017 | A1 | 6/2006 | Hayashi et al. | |
| 2010/0136842 | A1 | 6/2010 | Sakamoto et al. | |
| 2013/0183842 | A1 * | 7/2013 | Shishikura et al. | 439/147 |

FOREIGN PATENT DOCUMENTS

| | | |
|---|---|---|
| JP | 2007-95360 | 4/2007 |
| JP | 2011-96397 | 5/2011 |

OTHER PUBLICATIONS

European Search Report for Application No. 12198287.0, dated Feb. 21, 2014, 7 pages.

* cited by examiner

*Primary Examiner* — Chandrika Prasad
(74) *Attorney, Agent, or Firm* — Barley Snyder

(57) ABSTRACT

The invention relates to an electrical connector having a first contact housing, a second contact housing, and a lock housing. The first contact housing includes a housing protrusion disposed on a rear end portion thereof, and the second contact housing is positioned over the first contact housing. The lock housing includes a base portion positioned across the second contact housing and a deformable lock arm extending from the base portion toward the first contact housing. The deformable lock arm includes an engaging protrusion facing the first contact housing and is deformable by the first contact housing when not engaged with the housing protrusion.

19 Claims, 8 Drawing Sheets

Prior Art

ELECTRICAL CONNECTOR HAVING A DEFORMABLE LOCK ARM

CROSS-REFERENCE TO RELATED APPLICATIONS

This application claims the benefit of the filing dates under 35 U.S.C. §119(a)-(d) of JP Patent Application No. 2011-288047, filed on Dec. 28, 2011.

FIELD OF THE INVENTION

The invention relates to an electrical connector and, more particularly, to an electrical connector having multi-stacked contact housings.

BACKGROUND

In recent years, the number of terminals for an electrical connector (hereinafter, an electrical connector is sometimes referred to simply as "connector") for use in the field of automobiles and the like has increased.

Accordingly, there is a known electrical connector having multi-stacked and combined contact housings, wherein each housing accommodates a plurality of terminals aligned side by side in one direction (for example, as disclosed in Japanese Patent Laid-Open No. 2007-95360 and Japanese Patent Laid-Open No. 2011-96397). Each of the stacked contact housings includes a protrusion and an engaging piece to be engaged with this protrusion, formed on its side face. Thus, the vertically aligned contact housings are coupled together when the protrusion of one of the contact housings engages with an engaging piece on the other contact housing.

Moreover, as shown in FIG. 8, there is a known connector 5 in which a lock housing 3 having an arm 2 couples with all stacked contact housings 1.

The arm 2 extends along the side face of the multi-stacked connector housings 1, and has engaging portions that are formed therein at positions corresponding to the respective connector housings 1. The engaging portions of the arm 2 engage with a protrusion and a recess, not shown, formed along each of the connector housings 1. Thus, by engaging the protrusion and the recess of the respective housings 1 on the respective stage with the respective engaging portions of the arm 2, the multi-stacked connector housings 1 are integrally coupled with one another.

However, in the above-mentioned structure, it is difficult to detect when the respective connector housings are not completely engaged with each other, and a known connector may mate with the mating connector when the multi-stacked connector housings are not incomplete engaged with each other. In such a case, the connector housings and the contacts may be deformed, or it is possible that the contacts held on one connector are not correctly mated with the contacts held on the other connector, and thus the both contacts are not electrically connected with each other.

SUMMARY

In view of these technical problems, an electrical connector is provided.

The electrical connector includes a first contact housing, a second contact housing, and a lock housing. The first contact housing includes a housing protrusion disposed on a rear end portion thereof, and the second contact housing is positioned over the first contact housing. The lock housing includes a base portion positioned across the second contact housing and a deformable lock arm extending from the base portion toward the first contact housing. The deformable lock arm includes an engaging protrusion facing the first contact housing and is deformable by the first contact housing when not engaged with the housing protrusion.

BRIEF DESCRIPTION OF THE DRAWINGS

The invention will be explained in greater detail in the following with reference to embodiments, referring to the appended drawings, in which.

DETAILED DESCRIPTION OF THE EMBODIMENT(S)

The following description will discuss the present invention in detail based upon embodiments illustrated in the attached drawings.

Figure 1:
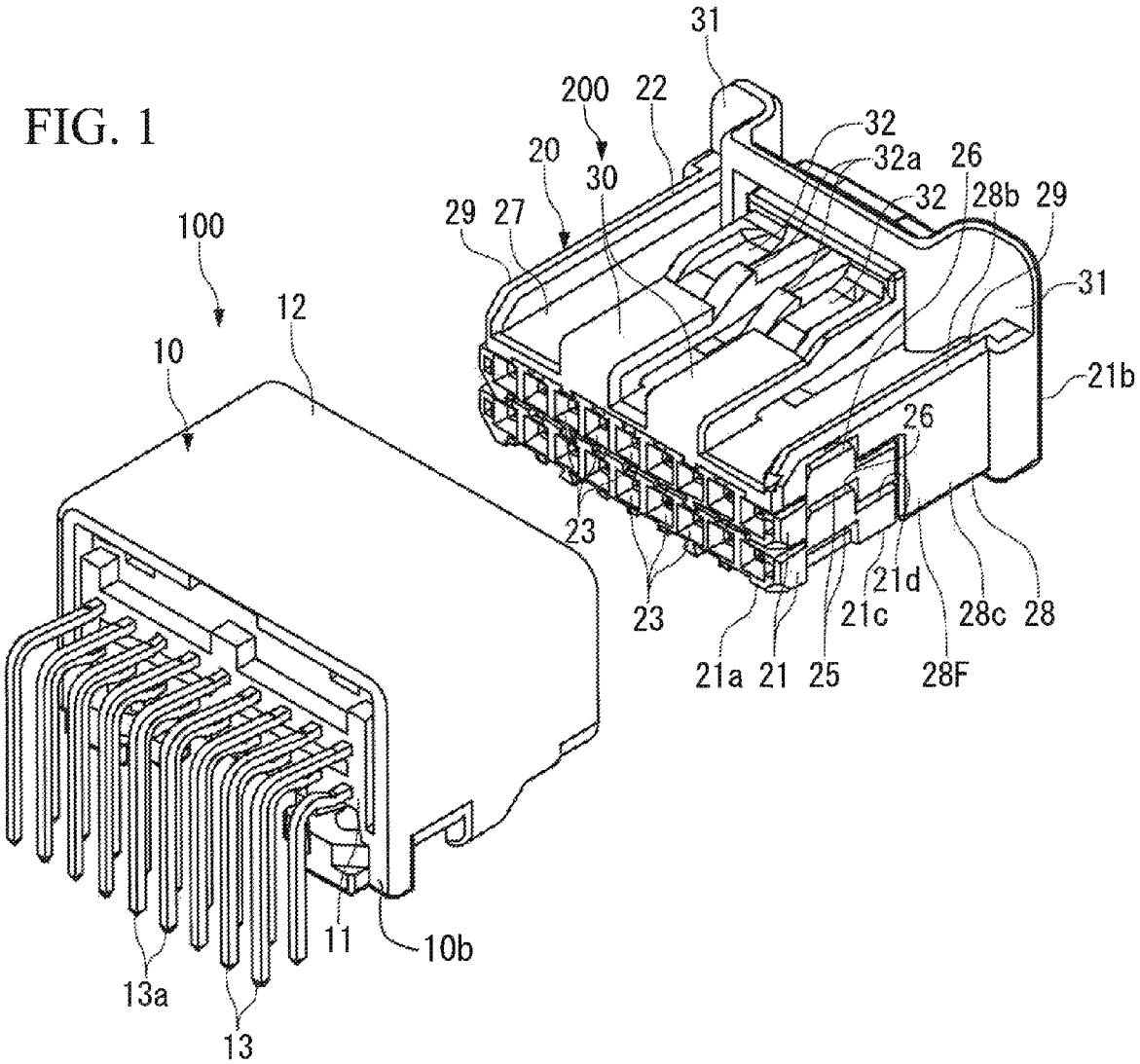
FIG. 1 is a perspective view an electrical connector according to the invention that faces a mating connector.
Figure 2:
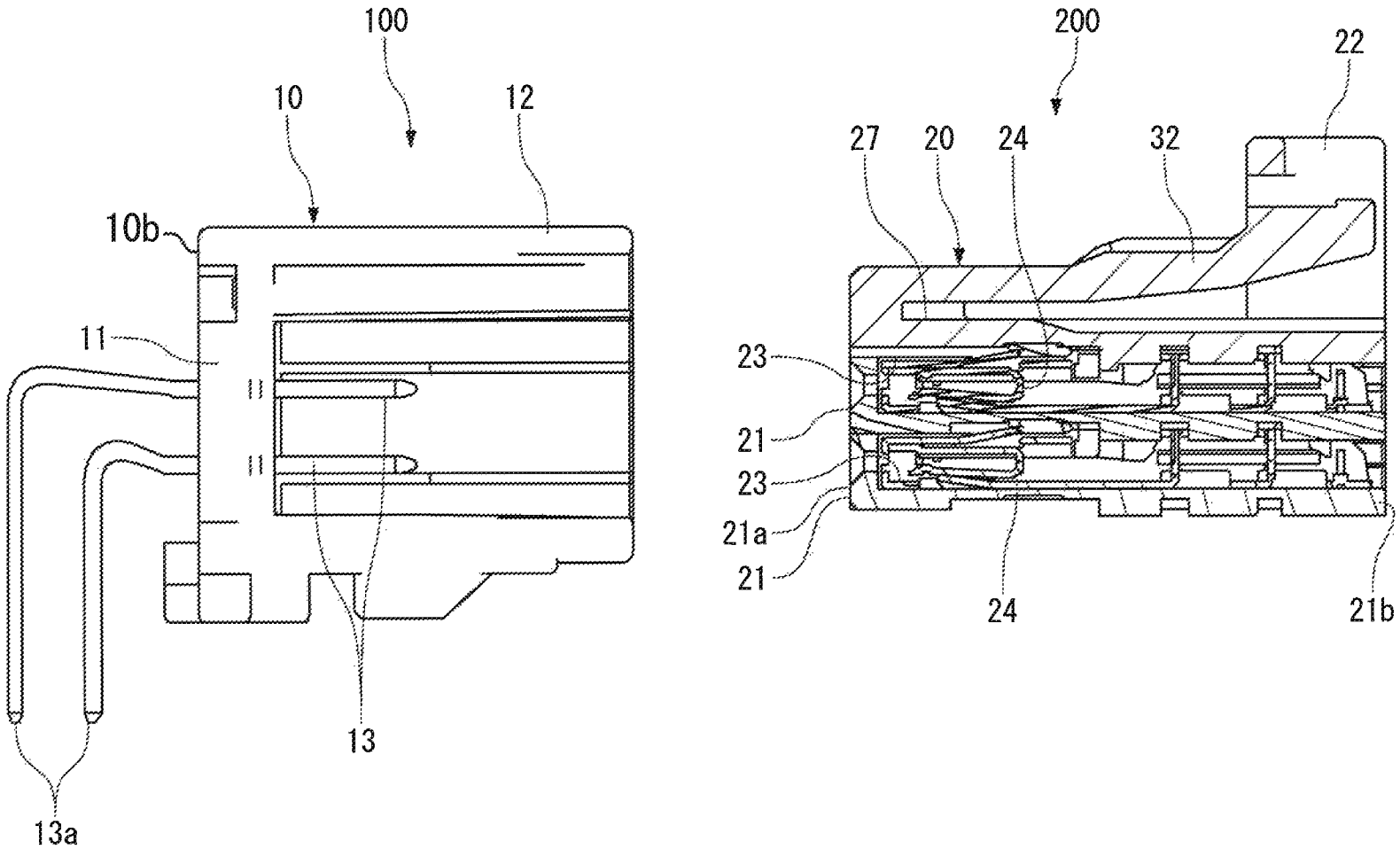
FIG. 2 is a sectional side view of the electrical connector and mating connector shown in FIG. 1.

As shown in FIG. 1 and FIG. 2, an electrical connector 200 according to the invention, such as a male connector, includes housing 20 and is to be mated with a mating connector 100, such as female connector, includes a mating housing 10. The mating housing 10 accommodates a plurality of male contacts 13, while the housing 20 accommodates a plurality of female contacts 24, in the embodiment shown.

The mating housing 10 of the mating connector 100 is made of an insulating material such as a resin, and includes a terminal holding portion 11 for use in holding the plural male contacts 13.

The mating housing 10 includes a cylindrical hood portion 12 that extends from the terminal holding portion 11 toward a side to be mated with the electrical connector 200. On the inside of the hood portion 12, male contacts 13, held on the terminal holding portion 11, are installed such that they protrude from the terminal holding portion 11 toward the side to be mated with the electrical connector 200. In addition, the tip portion 13*a* of each of the male contacts 13 that protrude from a surface 10*b* of the mating housing 10 is electrically connected to a wiring pattern of a circuit substrate, not shown.

Furthermore, the hood portion 12 includes guide grooves 15 and 16 (see FIG. 5B) for use in guiding the housing 20 of the electrical connector 200, which will be described later.

The housing 20 of the electrical connector 200 is made of an insulating material such as a resin.

The housing 20 includes multi-stacked contact housings 21, such as contact housings, two stages in the present embodiment, and a lock housing 22 that is integrally engaged with these contact housings 21. Additionally, in the following explanation, the stacking direction of the contact housings 21 is referred to as a vertical direction, the lock housing 22 side is referred to as an upper side, and the side opposite thereto is referred to as a lower side, in some cases.

In each of the contact housings 21, a plurality of contact receiving passageways 23 are formed side by side along a common plane. Each contact receiving passageway 23 penetrates in a direction connecting a first face 21*a* that is opposed to the mating connector 100 with its opposite second face 21*b*, and female contacts 24 made of a conductive material are inserted in the contact receiving passageways 23 (see FIG. 2). In addition, in each of the contact housings 21, a wire (not shown) connected to the female contact 24 is drawn from the second face 21*b* side.

Figure 3:
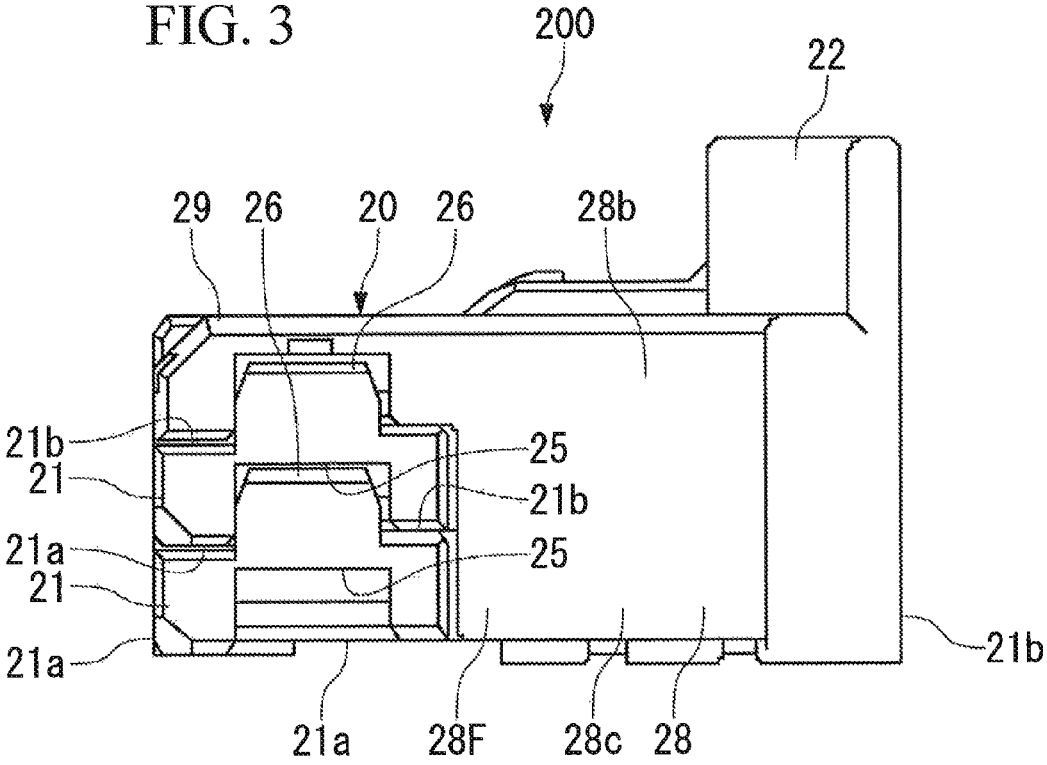
FIG. 3 is a side view of the electrical connector according to the invention.

As shown in FIG. 1 and FIG. 3, for each of the contact housings 21, a recess 25 is formed on a lower surface 21*c* side and a protrusion 26 is formed on an upper surface 21*d* side. Upon vertically stacking the plural contact housings 21, the protrusion 26 of the other (lower side) contact housing 21 is inserted into the recess 25 of one (upper side) of the contact housings 21, in order to prevent the contact housings from deviating from each other in a direction connecting the first face 21*a* to the second face 21*b* (this direction is referred to sometimes as a front-to-rear direction).

As shown in FIG. 1, the lock housing 22 includes a base portion 27, such as a cover plate, which covers the upper side of the multi-stacked contact housings 21 and lock arms 28 located along the two side faces of the multi-stacked contact housings 21.

The base portion 27 includes protruding bars 29 and 30 on its surface that continue from front to rear thereof. The protruding bars 29 are disposed along two opposite sides of the base portion 27. In the shown embodiment, the protruding bars 29 extend orthogonal to a major surface of the base portion 27. The protruding bars 30 are formed on the center portion with respect to the two opposite sides of the base portion 27. These protruding bars 29, 30 are inserted into the guide grooves 15, 16, such as to guide the electrical connector 200 when mating with the mating connector 100.

A wall portion 31 is disposed on each of the rear end portions of the protruding bars 29, and extends in a direction orthogonal to the surface of the base portion 27.

Moreover, an elastic lock 32 is disposed on the rear end portion of the protruding bar 30, and substantially extends in parallel to the base portion 27. A locking claw 32*a* is formed on the upper surface of the elastic lock 32. The locking claw 32*a* can engage with an engaging recess (not shown), which is formed on an inner circumferential surface of the guiding groove 16, in order to maintain connection between the housing 20 with the mating housing 10 of the mating connector 100.

The lock arms 28 extend downward from the base portion 27 in such a manner as to follow the two side faces of the multi-stacked contact housings 21 on both of the two opposite sides of the base portion 27.

Figure 5A:
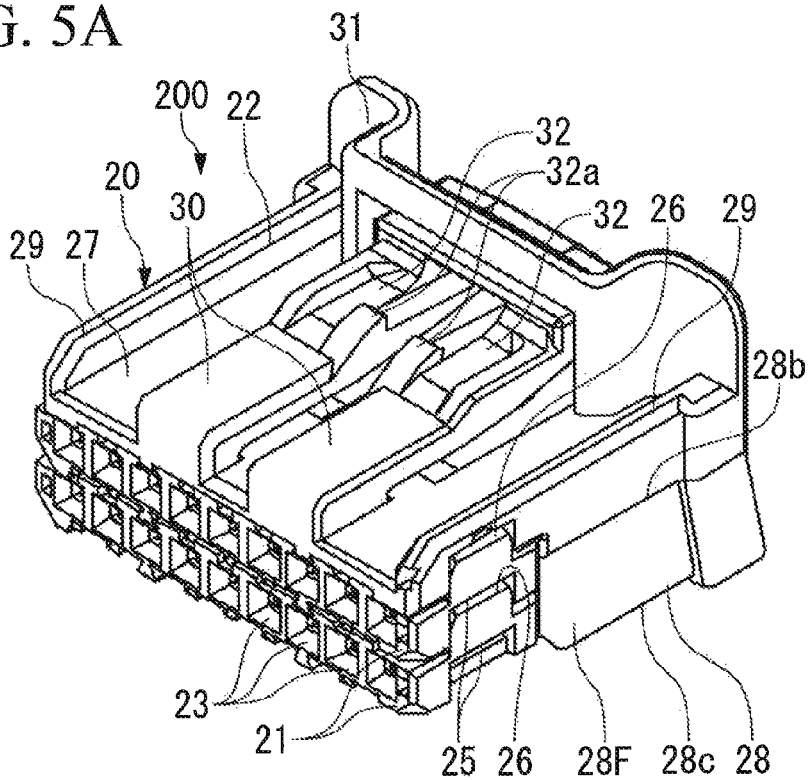
FIG. 5A is a front perspective view of the electrical connector with a lock arm that is elastically deformed.
Figure 5B:
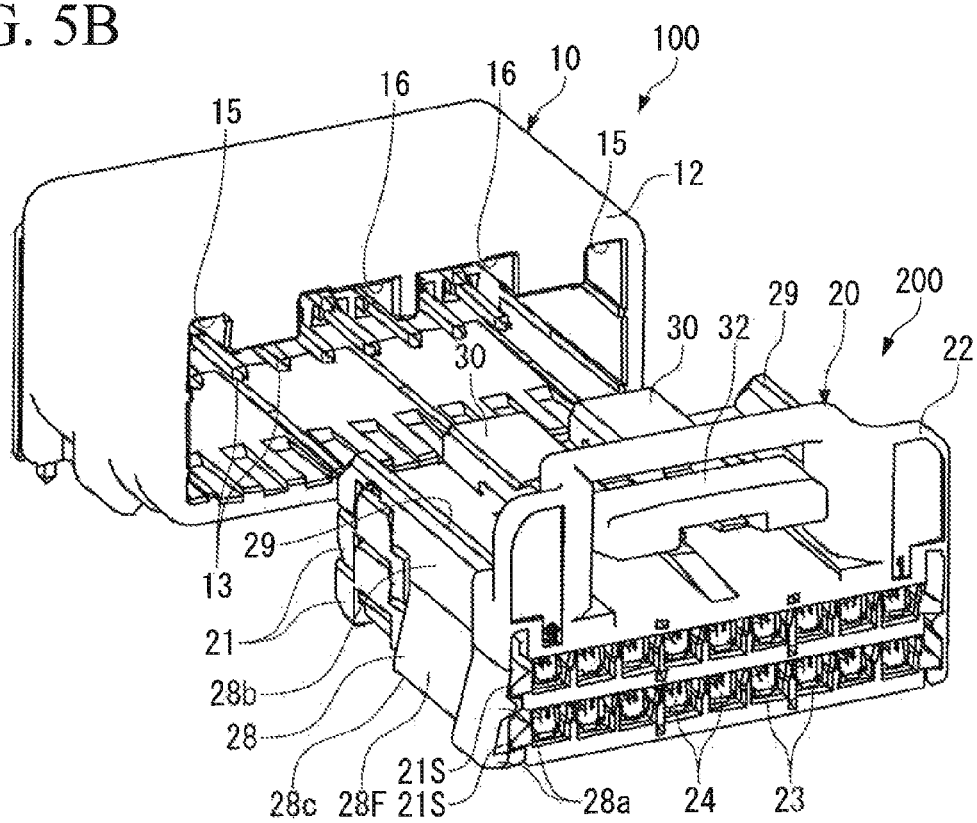
FIG. 5B is a rear perspective view of the electrical connector of FIG. 5A, shown being inserted into the mating connector.

As shown in FIG. 5B, each lock arm 28 includes engaging protrusions 28*a* on the side facing the multi-stacked contact housings 21. The engaging protrusions 28*a* engage with protrusions 21*s* disposed on the rear end portions of each of the contact housings 21

Each lock arm 28 has a support portion 28*b* extending from the base portion 27 and a tip portion 28*c* positioned along an opposite side with respect to the support portion 28*b*. The tip portion 28*c* is elastically deformable in a direction orthogonal to the side faces of the stacked contact housings 21, that is, in a departing direction therefrom, around the support portion 28*b*.

Figure 4:
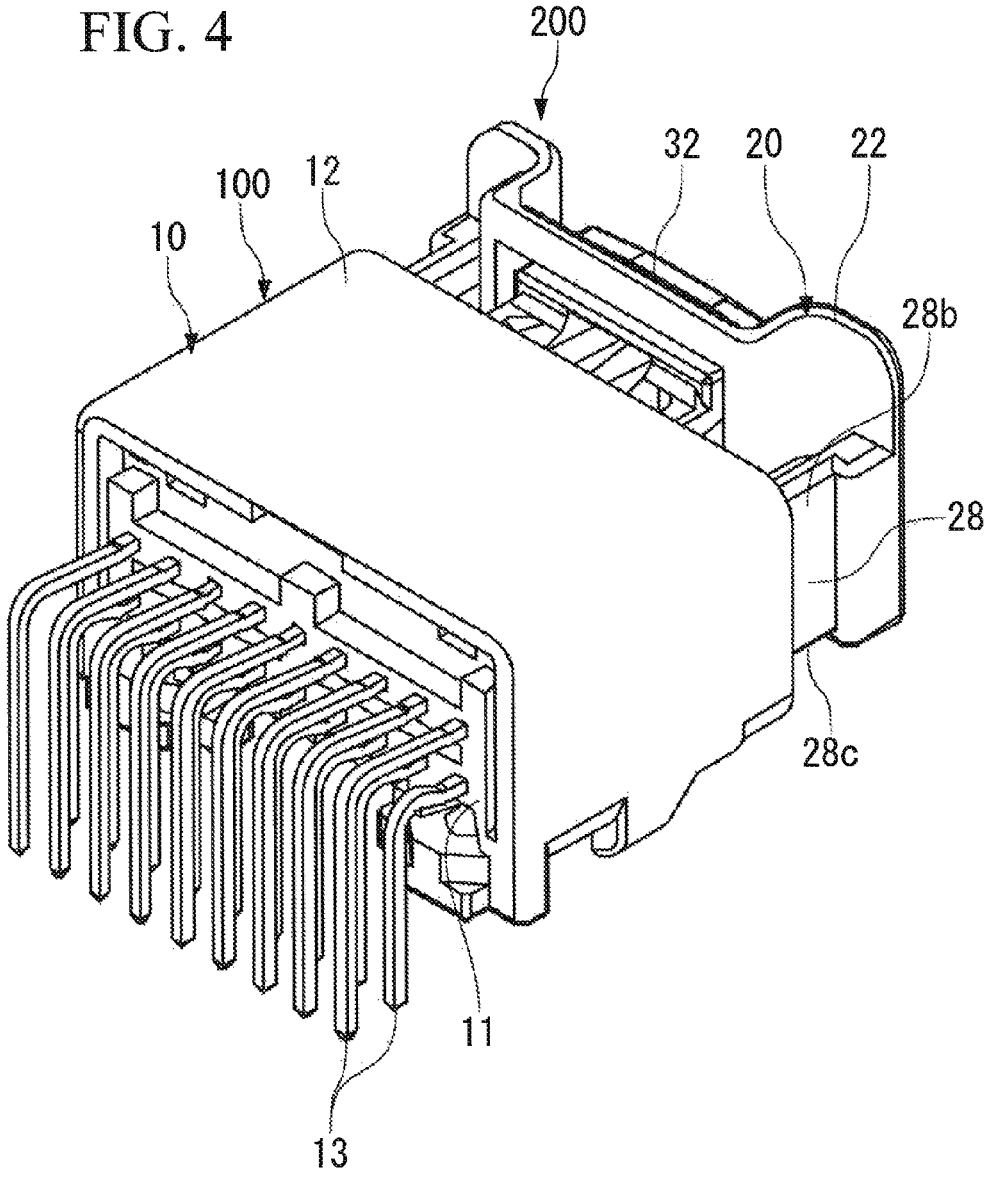
FIG. 4 is a perspective view of the electrical connector mating with the mating connector.

As shown in FIGS. 1 and 4, each lock arm 28 is designed such that a front portion 28F is inserted into the hood portion 12 of the mating housing 10 when the engaging protrusion 28*a* is engaged with the housing protrusion 21*s* of each of the contact housings 21. With this arrangement, the lock arm 28 is held between the side face of each contact housing 21 and the inner circumferential surface of the hood portion 12 so that its deformation in a direction orthogonal to the side faces of the contact housings 21 is prevented. Furthermore, when the front portion 28F of each lock arm 28 is inserted into the hood portion 12, it is possible to prevent the lock arm 28 from undesirably coming off.

Figure 6A:
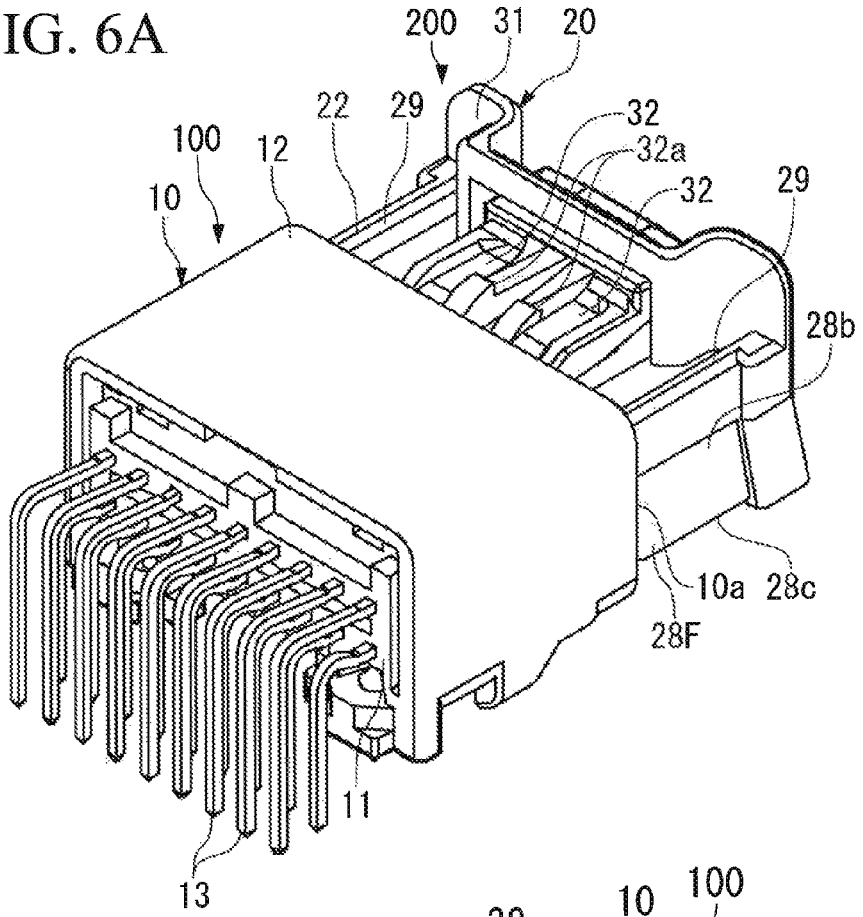
FIG. 6A is a front perspective view of the electrical connector being inserted into the mating connector, show the elastically deformed lock arm interfering with a housing of the mating connector.
Figure 6B:
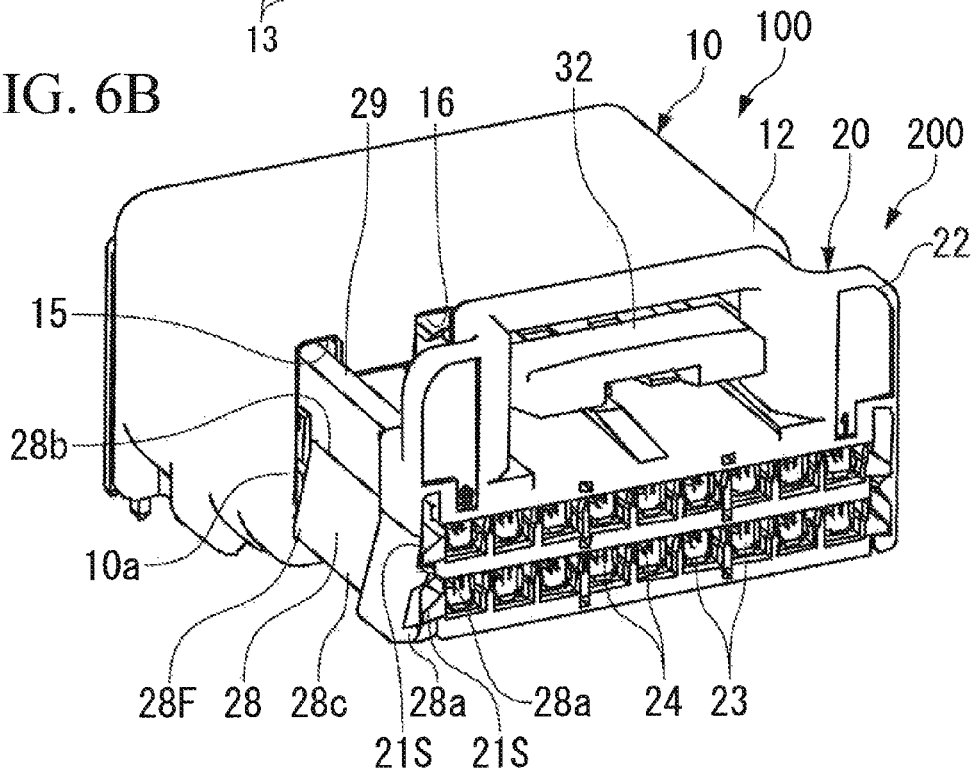
FIG. 6B is a rear perspective view of the electrical connector being inserted into the mating connector, show the elastically deformed lock arm interfering with a housing of the mating connector.

In this case, as shown in FIGS. 5A and 5B, the tip portions 28*c* deforms outward to protrude from the two opposite side faces of the multi-stacked contact housings 21 when the housing protrusion 21*s* and the engaging protrusion 28*a* are not correctly engaged with each other. As a result, the tip portion 28*c* of each protruding lock arm 28 interferes with the front end face 10*a* of the mating housing 10 of the mating connector 100 when the housing 20 of the electrical connector 200 tries to mate with the mating housing 10, thereby preventing the further insertion thereof (see FIGS. 6A and 6B).

With this arrangement, the electrical connector 200 cannot forcefully mate with the mating connector 100 when the plural contact housings 21 and the lock housing 22 are not correctly assembled with each other, and only the electrical connector 200 which has been correctly assembled can mate with the mating connector 100. Thus, the housings 10 and 20 as well as the male contacts 13 and the female contacts 24 are prevented from deformation due to a forceful mating operation between them.

Figure 7:
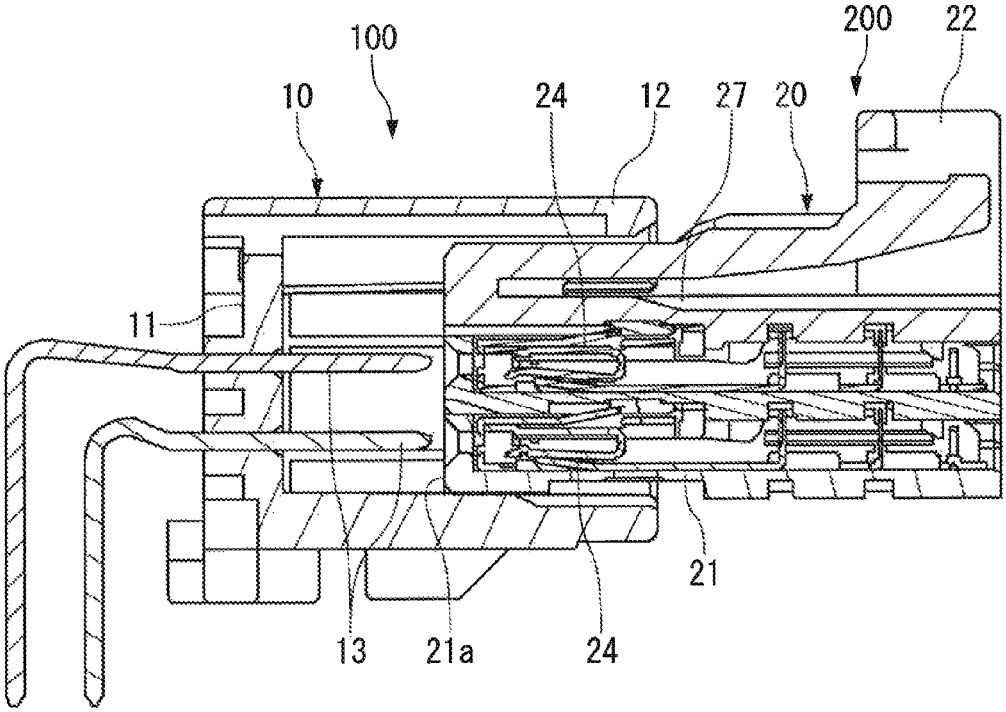
FIG. 7 is a sectional side view of the electrical and mating connectors shown in FIGS. 6A and 6B.
Figure 8:
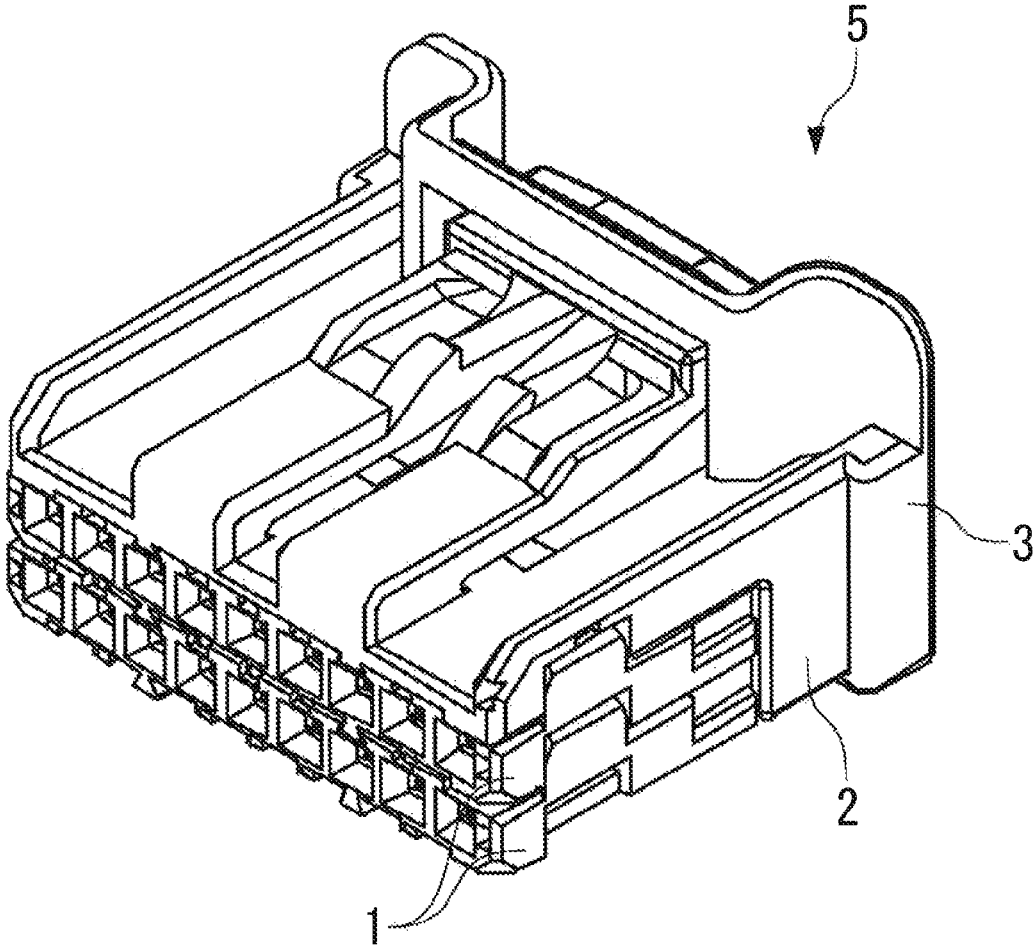
FIG. 8 is a perspective view that shows a structure of a known electrical connector.

As shown in FIG. 7, it is preferable that each set of the male contacts 13 and female contacts 24 be positioned such that contact cannot be made between the male contacts 13 and female contacts 24 when the tip portion 28*c* abuts against the front end face 10*a* of the mating housing 10. With this arrangement, it is possible to prevent deformation of each male contact 13 and each female contact 24 when the lock arm 28 is deformed to protrude outward.

Since the tip portion 28*c* deforms outward when the plural contact housings 21 and the lock housing 22 are not correctly assembled with each other, it is easy to detect misalignment because the lock arm 28 interferes with the mating housing 10 to prevent the mating operation. Therefore, it is possible to correctly mate the mating connector 100 with the electrical connector 200 having the multi-stacked contact housings 21 when the plural contact housings 21 and the lock housing 22 are correctly assembled with each other.

Moreover, since the assembling worker can detect the fact that the contact housings 21 are not correctly assembled, these can be selected as defective products, thereby making it possible to improve the product quality.

The structures of the mating connector 100 and the electrical connector 200 described above are only exemplary embodiments, and these structures may be modified to any other structures without departing from the gist of the present invention.

For example, the lock arms 28 are disposed along on two opposite sides. However, one skilled in the art should appreciate that one lock arm 28 may be installed on either one of the opposite sides.

Furthermore, the structure in which the lock arms 28 engage with the contact housings 21 on the respective stages is shown. However, one skilled in the art should appreciate that the lock arms 28 engage may only engage the contact housing 21 on the lowest stage.

Furthermore, the structure in which the contact housings 21 are stacked on two stages is exemplified; however, it is needless to say that these may be stacked on three or more stages.

The foregoing illustrates a possibility for preparing and practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical connector comprising:

a first contact housing having a housing protrusion disposed on a rear end portion thereof;

a second contact housing positioned over the first contact housing; and a lock housing having a base portion positioned across the second contact housing, and a deformable lock arm extending from the base portion toward the first contact housing and having an engaging protrusion facing the first contact housing and deformable by the first contact housing when not engaged with the housing protrusion.

2. The electrical connector according to claim 1, wherein the deformable lock arm includes a support portion extending from the base portion and a tip portion extending from the support portion.

3. The electrical connector according to claim 2, wherein the tip portion is elastically deformable in a direction orthogonal to a side of the first contact housing.

4. The electrical connector according to claim 1, wherein the second contact housing includes a recess disposed on a lower surface thereof.

5. The electrical connector according to claim 4, wherein the first contact housing includes a protrusion disposed on an upper surface thereof and corresponding with the recess.

6. The electrical connector according to claim 1, wherein the base portion includes a pair of protruding bars disposed along a major surface thereof.

7. The electrical connector according to claim 6, wherein the pair of protruding bars extending from a front edge to a rear edge of the base portion.

8. The electrical connector according to claim 6, wherein the pair of protruding bars are disposed along a pair of opposite sides of the base portion.

9. The electrical connector according to claim 8, wherein the pair of protruding bars extend orthogonal to the major surface of the base portion.

10. The electrical connector according to claim 6, wherein the lock housing further includes a wall portion disposed on each rear end portion of the pair of protruding bars.

11. The electrical connector according to claim 10, wherein the wall portion extends orthogonal to the major surface of the base portion.

12. The electrical connector according to claim 6, further comprising another protruding bar disposed on the base portion and along a center with respect to the pair of opposite sides of the base portion.

13. The electrical connector according to claim 12, wherein the lock housing includes an elastic lock disposed on a rear end portion of the another protruding bar.

14. The electrical connector according to claim 13, wherein the elastic lock extends substantially parallel to the major surface of the base portion.

15. The electrical connector according to claim 14, further comprising a locking claw disposed along an upper surface of the elastic lock.

16. An electrical connector assembly, comprising:

an electrical connector comprising:

a first contact housing having a contact received therein and a protrusion disposed on a rear end portion thereof;

a second contact housing positioned over the first contact housing and having another contact received therein; and a lock housing having a base portion positioned across the second contact housing, and a deformable lock arm extending from the base portion and toward the first contact housing and having an engaging protrusion facing the first contact housing and deformable by a side of the first contact housing when not engaged with the protrusion; and a mating connector connectable with the electrical connector and having a hood portion.

17. The electrical connector according to claim 16, wherein the deformable lock arm interferes with a connection between the electrical connector and the mating connector during mating when deformed by the first contact housing.

18. The electrical connector according to claim 17, wherein the hood portion receives the deformable lock arm during the connection and the engaging protrusion engages the protrusion.

19. The electrical connector according to claim 17, wherein when the deformable lock arm interferes with the connection, male contacts in the mating connector are spaced apart from the contacts in the first contact housing and the contacts in the second contact housing.

* * * * *